US008520862B2

(12) United States Patent
Scholz

(10) Patent No.: US 8,520,862 B2
(45) Date of Patent: Aug. 27, 2013

(54) AUDIO SYSTEM

(75) Inventor: Leander Scholz, Salching (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 802 days.

(21) Appl. No.: 12/592,282

(22) Filed: Nov. 20, 2009

(65) Prior Publication Data

US 2010/0128880 A1 May 27, 2010

(30) Foreign Application Priority Data

Nov. 20, 2008 (EP) ..... 08020241

(51) Int. Cl.
*H04R 1/40* (2006.01)

(52) U.S. Cl.
USPC ..... 381/97; 381/303; 381/119

(58) Field of Classification Search
USPC ..... 381/1–23, 27–28, 86, 300–311, 97–103, 381/119; 700/91, 94
See application file for complete search history.

(56) References Cited

U.S. PATENT DOCUMENTS

| | | | | |
|---|---|---|---|---|
| 3,786,193 | A * | 1/1974 | Tsurushima | 381/22 |
| 5,068,897 | A | 11/1991 | Yamato et al. | |
| 5,109,415 | A | 4/1992 | Ishida | |
| 5,339,363 | A * | 8/1994 | Fosgate | 381/97 |
| 5,862,228 | A | 1/1999 | Davis | |
| 5,889,867 | A | 3/1999 | Bauck | |
| 6,636,608 | B1 * | 10/2003 | Kishii et al. | 381/18 |
| 6,937,737 | B2 | 8/2005 | Polk | |
| 6,956,954 | B1 | 10/2005 | Takemura et al. | |
| 7,451,006 | B2 * | 11/2008 | Eid et al. | 700/94 |
| 7,676,047 | B2 * | 3/2010 | Aylward et al. | 381/97 |
| 8,139,797 | B2 * | 3/2012 | Aylward et al. | 381/302 |
| 2003/0039366 | A1 | 2/2003 | Eid et al. | |
| 2004/0032955 | A1 | 2/2004 | Hashimoto et al. | |
| 2005/0074135 | A1 | 4/2005 | Kushibe | |
| 2005/0089181 | A1 | 4/2005 | Polk, Jr. | |

FOREIGN PATENT DOCUMENTS

| | | |
|---|---|---|
| EP | 1387601 | 2/2004 |
| JP | 3437371 | 6/2003 |

OTHER PUBLICATIONS

Pulkki et al., "Localization of Amplitude-Panned Virtual Sources I: Stereophonic Planning", J. Audio Eng. Soc., vol. 49, No. 9, Sep. 2001.

* cited by examiner

*Primary Examiner* — Vivian Chin
*Assistant Examiner* — Fatimat O Olaniran
(74) *Attorney, Agent, or Firm* — O'Shea Getz P.C.

(57) ABSTRACT

An audio system for enhancing localization of sound perceived by a listener in a listening position includes two loudspeakers and a signal processing unit. The loudspeakers are arranged distant from each other and from the listening position. The sound is transmitted from each of the loudspeakers to the listening position according to a respective transfer function. The transfer functions have different phase responses over frequency. The signal processing unit is connected upstream of the loudspeakers and receives two electrical input signals to be radiated as respective sound signals by the two loudspeakers. The signal processing unit includes a phase shifter unit that phase-shifts at least one of the electrical input signals such that a difference in phase responses is constant over a substantial portion of the human audible frequency in a frequency band.

10 Claims, 9 Drawing Sheets

AUDIO SYSTEM

1. CLAIM OF PRIORITY

This patent application claims priority from European Patent Application No. 08 020 241.9 filed on Nov. 20, 2008, which is hereby incorporated by reference in its entirety.

2. FIELD OF TECHNOLOGY

This disclosure relates generally to an audio system and, more particularly, to a multi-channel audio system for enhancing the localization of sound at a listening position.

3. RELATED ART

Modern audio systems, in particular audio systems in motor vehicles, often have very complex designs. For example, a typical vehicle audio system includes a plurality of loudspeakers located at a various positions in a passenger compartment of the vehicle, and a so-called "surround processor" or a similar arrangement to generate, from a two-channel stereo signal, a multi-channel audio signal that provides an improved three-dimensional sound impression. Such surround processors, also referred to as "mixers" or "active matrix decoding systems", convert the two-channel signals into five-channel or seven-channel signals, for example, which are optimized for conventional stereo music recordings.

In a typical five-channel system, a loudspeaker arrangement for optimized three-dimensional audio signal reproduction includes a plurality of front loudspeakers, a plurality of rear loudspeakers, and a sub-bass loudspeaker (also referred to as a "subwoofer"). The front loudspeakers include a loudspeaker arranged on a front left hand side of the passenger compartment ("front left loudspeaker"), a loudspeaker arranged on a front right hand side of the passenger compartment ("front right loudspeaker"), and a center loudspeaker arranged, for example, between the front left and the front right loudspeakers. The rear loudspeakers include a loudspeaker arranged on a rear left hand side of the passenger compartment ("rear left loudspeaker"), and a loudspeaker arranged on a rear right hand side of the passenger compartment ("rear right loudspeaker"). In such a system, the sub-bass loudspeaker is typically used exclusively for reproducing low-frequency signal components of the audio signal and does not contribute to the three-dimensional effect of the reproduction. In a typical seven-channel system, the loudspeaker arrangement also includes a plurality of loudspeakers disposed midway between the front and the rear loudspeakers; e.g., at least one loudspeaker arranged on a left hand side of the passenger compartment and one loudspeaker arranged on a right hand side of the passenger compartment.

Disadvantageously, in such five-channel or seven-channel loudspeaker systems, configuring the center loudspeaker in the front center of the passenger compartment, for example in a center console, can be (i) aesthetically displeasing, and/or (ii) relatively complex. In addition, different passenger listening positions are typically not located symmetrically between left and right channels of a two-channel stereo or a multi-channel surround audio system. As a result, left and right channel transfer functions of such audio systems deviate considerably between left and right ears of listeners (e.g., a driver and a passenger). For example, when a listener is sitting in the left hand side of the listener compartment (e.g., in the driver seat), a distance between his left ear and the left channel loudspeakers is considerably smaller than a distance between his right ear and the right channel loudspeakers.

Similarly, when a passenger is sitting in the right hand side of the passenger compartment, a distance between his right ear and the right channel loudspeakers is considerably smaller than a distance between his left ear and the left channel loudspeakers. In such cases, even a "real" center speaker (i.e., a center loudspeaker physically in the front center of the passenger compartment) cannot always generate a perceived centered localization of sound signals (aural event direction) such that these appear to be located directly frontal to the respective listeners.

There is a need for a system that generates a spatial sound of a stereo or multi-channel audio system without using a center loudspeaker.

SUMMARY OF THE INVENTION

According to one aspect of the present invention, an audio system is provided for enhancing localization of sound perceived by a listener in a listening position. The system includes two loudspeakers and a signal processing unit. The loudspeakers are arranged distant from each other and from the listening position. The sound is transmitted from each of the loudspeakers to the listening position according to a respective transfer function. The transfer functions have different phase responses over frequency. The signal processing unit is connected upstream of the loudspeakers and receives two electrical input signals to be radiated as respective sound signals by the two loudspeakers. The signal processing unit includes a phase shifter unit that phase-shifts at least one of the electrical input signals such that a difference in phase responses is relatively constant over frequency in a frequency band.

According to another aspect of the present invention, a vehicle audio system is provided for enhancing localization of sound perceived at a listening position in a passenger compartment of a vehicle. The system includes a signal processing unit and a plurality of loudspeakers that include a first channel loudspeaker and a second channel loudspeaker. The signal processing unit receives a stereo input signal that includes a first channel signal and a second channel signal, and includes a phase shifter that phase shifts at least one of the first and the second channel signals such that a difference in phase response is substantially constant over frequency in a frequency band. The first channel loudspeaker is driven at least partially by the first channel signal and reproduces a first component of the sound according to a first transfer function. The second channel loudspeaker is driven at least partially by the second channel signal, and reproduces a second component of the sound according to a second transfer function. The first and the second loudspeakers are disposed in different locations within the passenger compartment. The first and the second transfer functions have different phase responses over frequency.

DESCRIPTION OF THE DRAWINGS

The invention can be better understood with reference to the following drawings and description. The components in the figures are not necessarily to scale, instead emphasis being placed upon illustrating the principles of the invention. Moreover, like reference numerals designate corresponding parts. In the drawings.

DETAILED DESCRIPTION

Figure 1A:
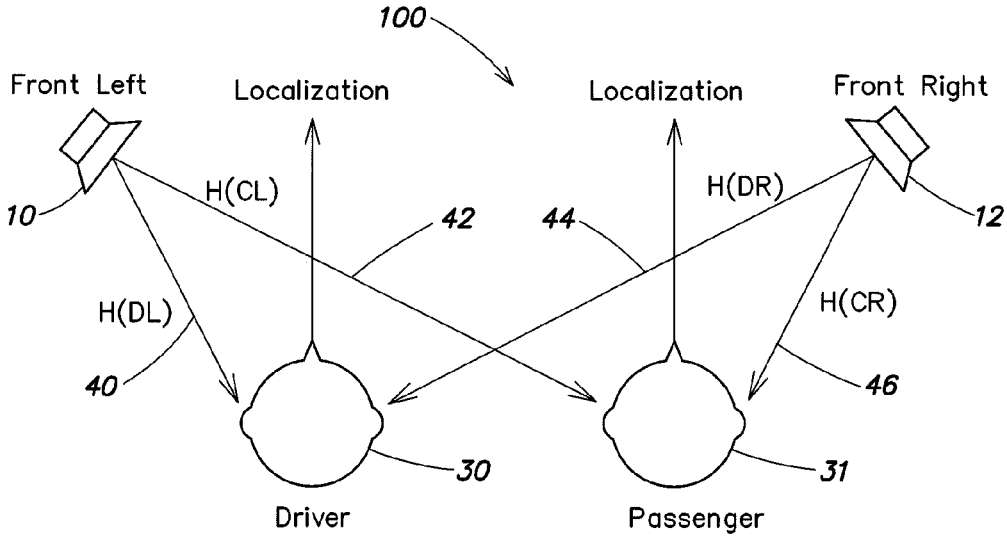
FIG. 1A is a block diagram illustration of an example a known audio system having left and right channels.

FIG. 1A illustrates a typical listening environment 100 for a driver 30 and a passenger 31 in a passenger compartment of a vehicle. The listening environment includes a front left loudspeaker 10 (i.e., a loudspeaker disposed in a front left hand portion of the passenger compartment) and a front right loudspeaker 12 (i.e., a loudspeaker disposed in a front right hand portion of the passenger compartment), where the driver 30 is seated in a front left hand seat (e.g., a driver seat) and the passenger 31 is seated in a front right hand seat. The loudspeakers 10, 12 produce sound waves that travel to respective left and right ears of the driver 30 and the passenger 31 (the "listeners") along, for example, a plurality of sound paths 40, 42, 44, 46.

Each of the sound paths may be represented by a corresponding transfer function. A transfer function H(DL) is indicative of the sound path 40 between the front left loudspeaker 10 and the left ear of driver 30. A transfer function H(CL) is indicative of the sound path 42 between the front left loudspeaker 10 and the left ear of the passenger 31. A transfer function H(DR) is indicative of the sound path 44 between the front right loudspeaker 12 and the right ear of the driver 30. A transfer function H(CR) is indicative of the sound path 46 between the front right loudspeaker 12 and the right ear of the passenger 31.

The transfer functions H(DL) and H(CL) are different since distances along the sound paths 40, 42 between the left ears of the listeners 30, 31 and the front left loudspeaker 10 are different. Similarly, the transfer functions H(DR) and H(CR) are different since distances along the sound paths 44, 46 between the right ears of the listeners 30, 31 and the front right loudspeaker 12 are different. As a consequence, disadvantageously the hearing sensations generated by the audio signals from the loudspeakers 10, 12 in the two listeners 30, 31 are substantially different. Particularly, phase responses of the transfer functions of left channels and right channels, and hence frequency dependent delays of the respective audio signals on the way to the ears of the listeners 30, 31 are substantially different.

Figure 1B:
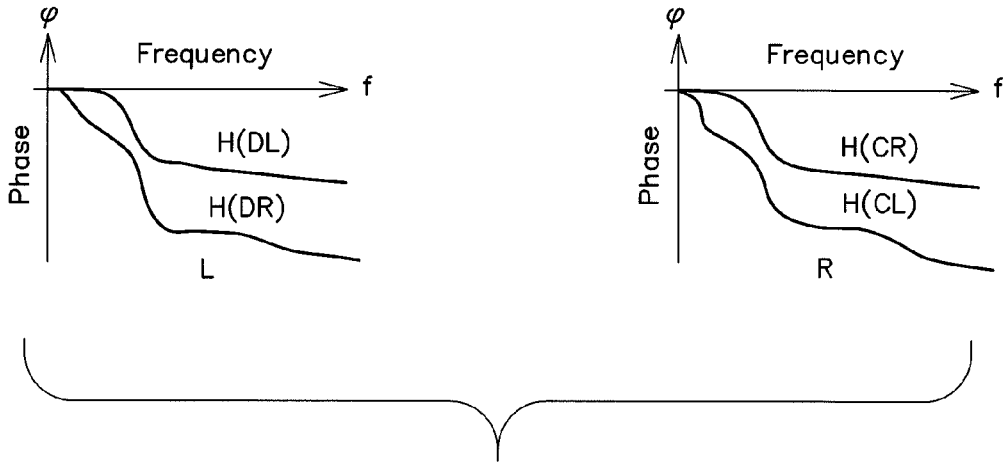
FIG. 1B illustrates phase responses of transfer functions for left and right audio signals reproduced by the system in FIG. 1A.

FIG. 1B illustrates the phase responses of the transfer functions for left and right audio signals (provided by the front left and the front right loudspeakers 10, 12) for the driver 30 (see diagram L) and the passenger 31 (see diagram R) as imposed by the respective transfer functions between loudspeakers and ears of the listeners 30, 31. The diagrams L and R in FIG. 1B illustrate a ratio of phase "φ" over frequency "f" for each pair of transfer functions related to the driver 30 and the passenger 31. As illustrated, the phase responses for the transfer functions from the loudspeakers 10, 12 are substantially different for the two listening positions (i.e., where the driver 30 and the passenger 31 are seated within the passenger compartment). As a result, an audio signal, which ideally should be perceived identical by both listeners 30, 31, can significantly deviate between the two listening positions.

Figure 1C:
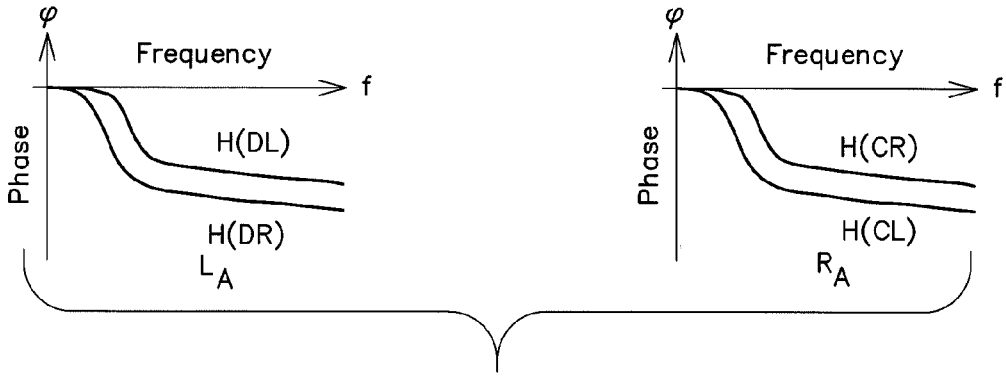
FIG. 1C illustrates phase responses of transfer functions for left and right audio signals according to one embodiment of the present invention.

In one embodiment of the present invention, phase responses of transfer functions of audio signals for different listening positions are aligned. This alignment generates a substantially similar hearing sensation independent of the seating position of a listener. For example, phase responses of the transfer functions aligned in parallel by use of such system are shown in FIG. 1C in diagrams $L_A$ and $R_A$.

Figure 2:
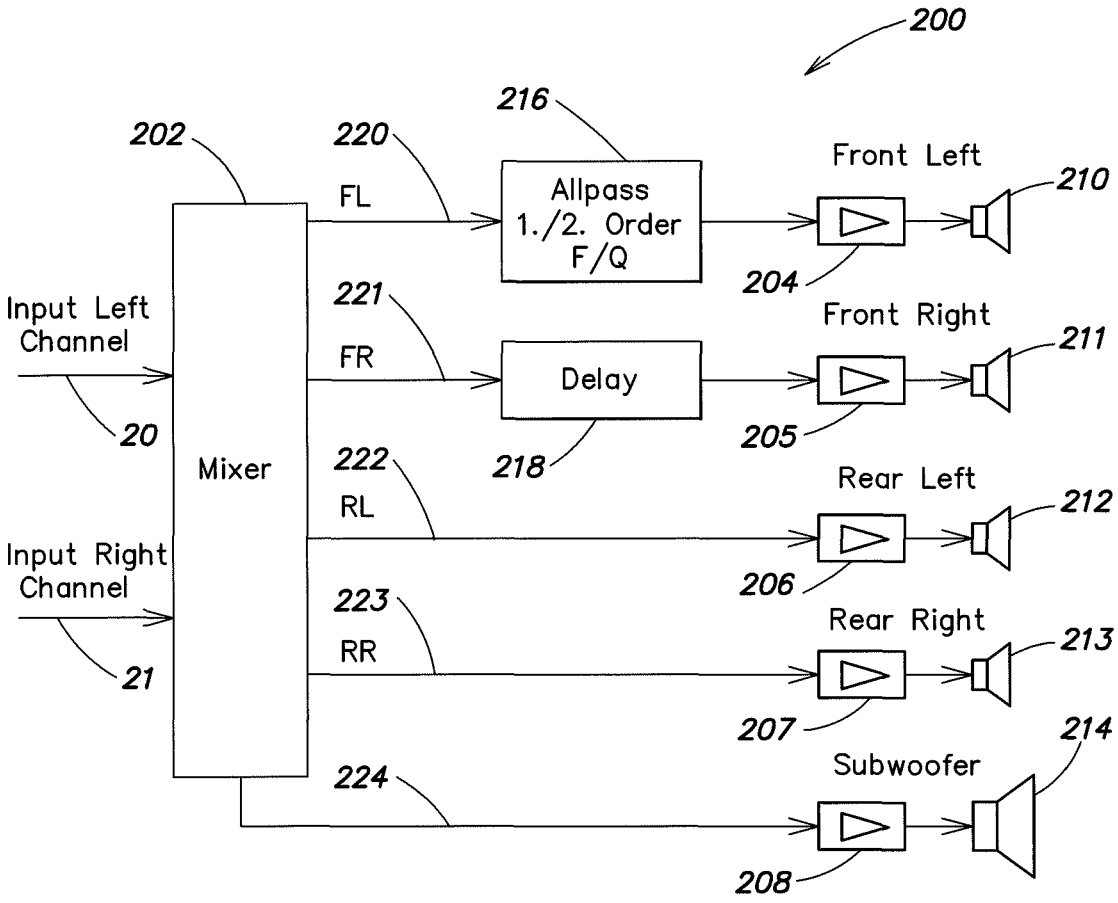
FIG. 2 is a block diagram illustration of one embodiment of an audio system having five channels.

FIG. 2 is a block diagram illustrating one embodiment of a multi-channel mixer system 200 for stereo input signals. The system includes a mixer 202, a plurality of signal amplifier units 204-208, a plurality of loudspeakers 210-214, an all-pass filter 216, and a signal delay unit 218. The mixer 202 receives the stereo input signals 20, 21 (e.g., left and right channel input signals of a two channel stereo signal). The mixer 202 utilizes the stereo input signals 20, 21 to generate signals (e.g., electrical audio signals) 220-224 for the loudspeakers 210-214, respectively.

The signal on the line 220 is filtered by the all-pass filter 216, amplified by the signal amplifier unit 204 and supplied to the front left loudspeaker 210, which is arranged in front and to the left of the listening positions, and thus the listeners 30, 31 (e.g., see FIG. 1A). The signal on the line 221 is delayed by the signal delay unit 218, amplified by the signal amplifier unit 205 and supplied to the front right loudspeaker 211.

In some embodiments (see FIG. 5), the system may include a left side (or mid-left) loudspeaker 542 arranged to the left of the listening positions (e.g., on the left hand side of a passenger compartment), and a right side (or mid-right) loudspeaker 544 arranged to the right of the listening positions (e.g., on the right hand side of the passenger compartment). The rear left loudspeaker 212 is arranged to the rear and to the left of the listening positions (e.g., on the rear left hand side of the passenger compartment), and the rear right loudspeaker 213 is arranged to the rear and to the right of the listening positions (e.g., on the rear right hand side of the passenger compartment).

The signal on the line 224, which is amplified by the signal amplifier 208, drives the sub-bass loudspeaker 214 (subwoofer). In this embodiment, the sub-bass loudspeaker 214 is used exclusively for reproducing low-frequency signal components of the audio signal and does not contribute to the three-dimensional effect of the reproduction, which is produced by the loudspeakers 210-213. The function of such a system is also referred to as "2 channel surround system".

By tuning the all-pass filter 216, alignment of (i) the phase response of the transfer function of audio signals traveling from the front left loudspeaker 210 to the left ear of a listener with (ii) the phase response of the transfer function of audio signals traveling from the front right loudspeaker 211 to the right ear of the same listener can be improved. As a result, there is less deviation between the frequency dependent phase responses of the transfer functions for the left and the right audio signals, which are independent of the seating position of a listener (see for example diagrams $L_A$ and $R_A$ in FIG. 1B).

Such tuning provides an improved localization of an audio signal of the multi-channel audio system 200.

Referring still to FIG. 2, the signal delay unit 218 compensates for the delay introduced by the all-pass filter 216 during the aforesaid tuning. Appropriate optional tuning of the signal delay unit 218 leads to the desired effect; i.e., that for a specific listening position, the delay introduced by the all-pass filter 216 is compensated and the respective phase responses become more congruent. As such, the system 200 optimizes the localization of a stereophonic audio signal for one specific seating position (i.e., listening position) of a listener in a specific listening environment; e.g., the driver in the passenger compartment of a motor vehicle.

As a result of the foregoing, for example, the components of a multi-channel audio signal are perceived as being directly in front of a listener. This effect is sometimes referred to as a "virtual center speaker" or a "phantom sound source". Alternatively, the same effects may be achieved by applying (e.g., connecting) an all-pass filter to the signal on the line 221 of the front right loudspeaker 211 and a signal delay unit to the signal on the line 220 of the front left loudspeaker 210. Similarly, a respective system may be applied to the signal paths of the rear left and the rear right loudspeakers 212, 213 to optimize the localization of an audio signal specifically for one or more seating positions of one or more listeners in the rear of the passenger compartment (not shown in FIG. 2). The present invention, however, is not limited to projecting a phantom sound source directly in front of or behind a listening position; e.g., the phantom sound source may be skewed to a front or a rear side of the listening position.

Figure 3:
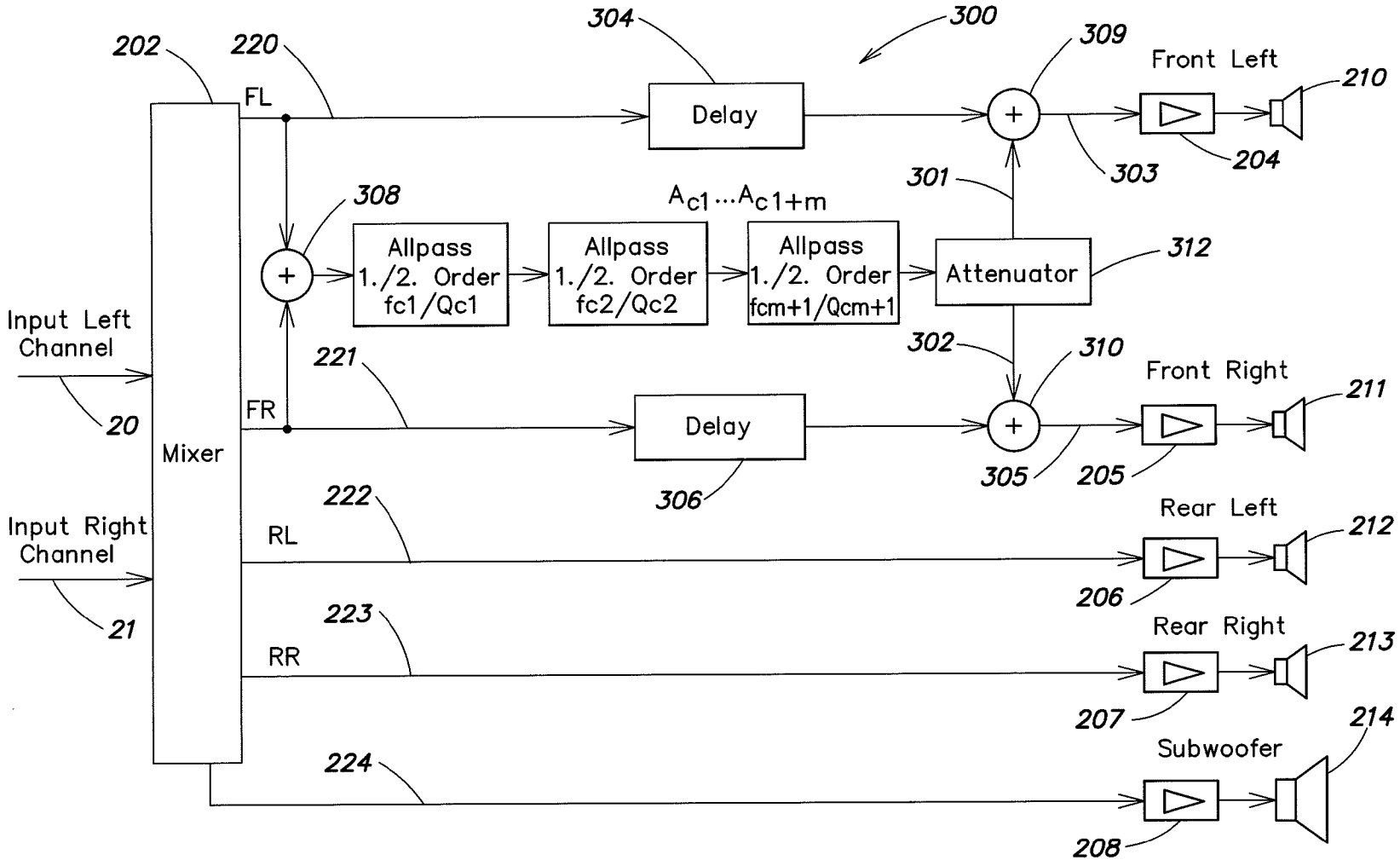
FIG. 3 is a block diagram illustration of another embodiment of an audio system having five channels.

FIG. 3 is a block diagram illustrating another embodiment of a multi-channel mixer system 300 for stereo input signals. The mixer system 300 is configured to improve localization of audio signals by providing a virtual center speaker. The system 300 includes the mixer 202, the signal amplifier units 204-208, the loudspeakers 210-214, a plurality of 1+m serially-connected all-pass filters $A_1 \ldots A_{1+m}$, a plurality of signal delay units 304, 306, a plurality of signal summing units 308-310, and an attenuator unit 312. The mixer 202 receives the right and the left channel input signals 20, 21 and generates respective mixer output signals 220-224. The signals on the lines 222-224 are amplified by the associated signal amplifier units 206-208 and supplied to their respective loudspeaker 212-214.

The first mixer output signal on the line 220 is fed through the signal delay unit 304 and the resultant amplified signal is supplied to the signal summing unit 309. The second mixer output signal on the line 221 is fed through the signal delay unit 306 and the associated delayed signal is input to the summing unit 310. The first and second mixer output signals are summed by the signal summing unit 308, and the resultant sum is filtered by the series of 1+m serially-connected all-pass filters $A_1 \ldots A_{1+m}$ and attenuated by the attenuator unit 312. An output signal from the attenuation unit 312 is fed to both the signal summing units 309 and 310 on lines 301 and 302. An output signal from the signal summing unit 309 is amplified by the downstream signal amplifier unit 204 and subsequently supplied to the front left loudspeaker 210. An output signal from the signal summing unit 310 is amplified by the downstream signal amplifier unit 205 and subsequently supplied to the front right loudspeaker 211.

The mixer output signals on the lines 222-224 respectively drive the loudspeakers 212-214. In this system 300, the loudspeaker 210 is arranged to the front and to the left of a listening position (e.g., the drive and/or passenger seat), and the loudspeaker 211 is arranged to the front and to the right of the listening position. The loudspeaker 212 is arranged to the rear and to the left of the listening position, and the loudspeaker 213 is arranged to the rear and to the right of the listening position.

The mixer output signal on the line 224 is amplified by the signal amplifier unit 208, and drives the sub-bass loudspeaker 214 (subwoofer). In this system, the sub-bass loudspeaker is used exclusively for reproducing low-frequency signal components of the audio signal and does not contribute to the three-dimensional effect of the reproduction, which is produced by the loudspeakers 210-213. A loudspeaker system as outlined above is also referred to as a "2-channel surround system".

By summing the left signal on the line 220 and the right signal on the line 221 via the signal summing unit 308, coherent signal components of the left and the right signals are strengthened, whereas incoherent signal components are mitigated. Coherent signal components in the left and the right signals relate to hearing sensations, which are to be perceived at a hearing sensation location somewhere between the front left and the front right loudspeakers 210, 211. Signal components in the signals on the lines 220 and 221, which are identical in amplitude and phase, are to be perceived, for example, "exactly" in the middle between the loudspeakers 210, 211. These hearing sensations are also referred to as "phantom sound source" or "virtual center speaker".

Referring still to FIG. 3, a phase response for the summed signal which is different from that for the single components of the signals on the lines 220 and 221 is formed by selecting an appropriate distribution for the group delay times (phase shifts) of the all-pass filters. Since the summed signal, following transmission via the 1+m all-pass filters $A_1, A_2 \ldots A_{1+m}$ and attenuation by the attenuator unit, is added to both the front left signal on the line 220 transmitted via the signal delay unit 304 and to the front right signal on the line 221 transmitted via the signal delay unit 306, this signal is also respectively reproduced by the loudspeakers 210, 211.

Thus, the phantom sound source is formed on an axis (e.g., an axis running between the listeners 30, 31 in FIG. 1A) between the two loudspeakers 210, 211, which corresponds to impressions of the listener and the aural event direction of, for example, a directly frontal signal. By varying the propagation delay via the 1+m all-pass filters $A_1, A_2 \ldots A_{1+m}$ and attenuation via the attenuator unit 312, the aural event location of the phantom sound source (the virtual center speaker) can be shifted, for example, to in front of or behind the transverse axis (azimuthal shifts) which runs through the two loudspeakers 210, 211.

By transmitting the summed signal components of signals on the lines 220-221 over the serially-connected all-pass filters $A_1 \ldots A_{1+m}$, a delay is imposed. This delay can be compensated for by appropriate tuning of the signal delay units 304, 306. Additional adjustments of the signal delay units 304, 306 can change the perceived location of the frontal sound event (e.g., laterally across the passenger compartment).

Figure 4:
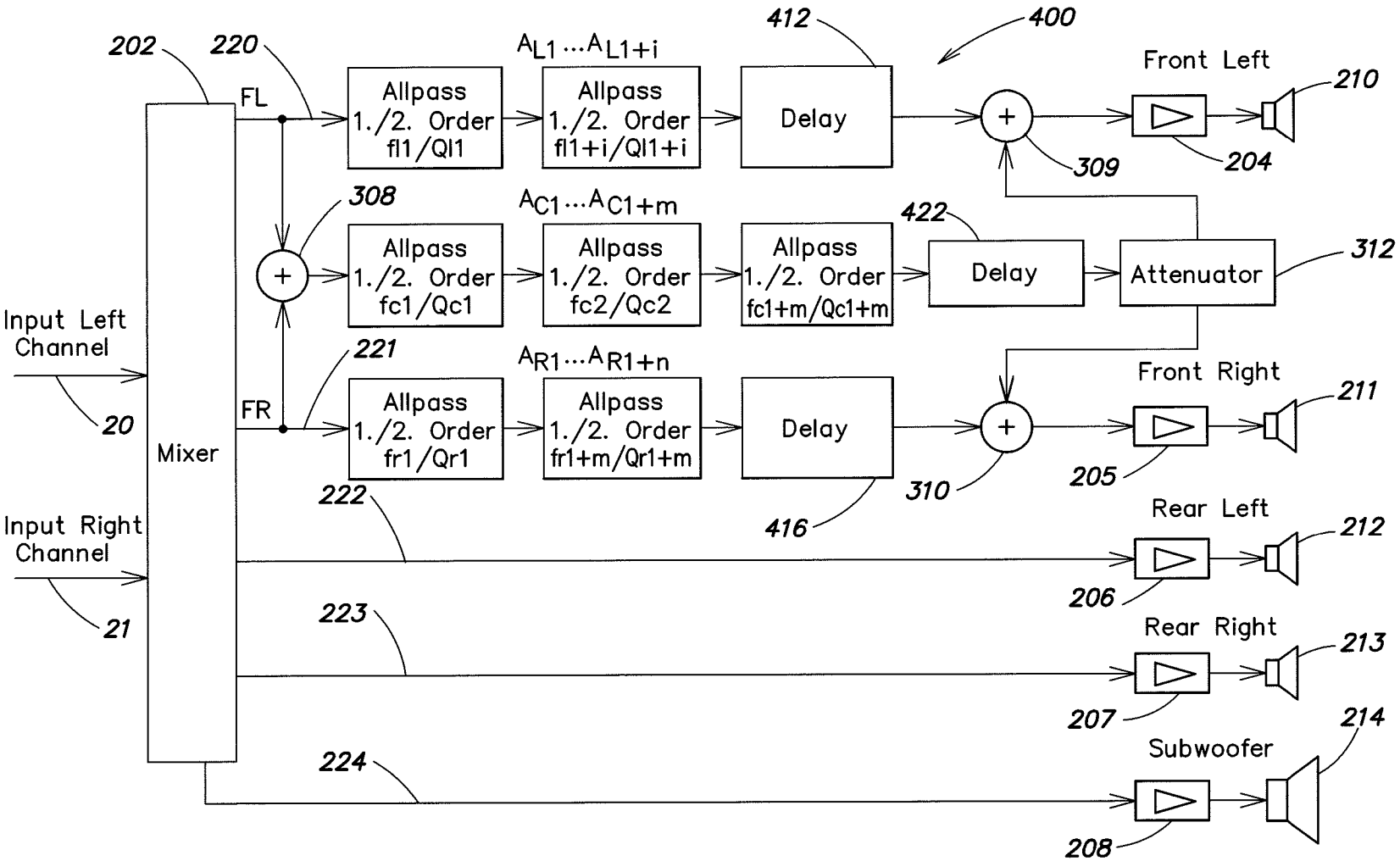
FIG. 4 is a block diagram illustration of yet another embodiment of an audio system having five channels.

FIG. 4 is a block diagram of another embodiment of a multi-channel mixer system 400 for stereo input signals. The mixer system 400 provides a virtual center speaker and aligns the phase responses of the transfer functions to the left and the right ears of the listeners. The system 400 includes the mixer 202, the signal amplifier units 204-208, the loudspeakers 210-214, a plurality of 1+i serially-connected all-pass filters $A_{L1} \ldots A_{L1+i}$, a plurality of 1+m serially-connected all-pass filters $A_{c1} \ldots A_{c1+m}$, a plurality of 1+n serially-connected all-pass filters $A_{R1} \ldots A_{R1+i}$, a plurality of signal delay units 412, 416 and 422, the signal summing units 308-310 and the attenuator unit 312. The mixer 202 receives the stereo input signals (e.g., left and right channel input signals of a two channel stereo signal). The mixer 202 uses the stereo input signals, to generate a plurality of mixer output signals on the lines 220-224 for the front left loudspeaker 210, the front right loudspeaker 211, the rear left loudspeaker 212, the rear right loudspeaker 213, and the subwoofer 214. The signals on the lines 222-224 are amplified by respective downstream signal amplifier units and are supplied to respective loudspeakers 212-214.

The front left signal on the line 220 is fed through the 1+i serially-connected all-pass filters $A_{L1} \ldots A_{L1+i}$ and the downstream signal delay unit 412, and then supplied to the input of signal summing unit 309. The signal on the line 221 is fed through the 1+n serially-connected all-pass filters $A_{R1} \ldots A_{R1+i}$ and the downstream signal delay unit 416, and then supplied to the input of the signal summing unit 310. The signals on the lines 220, 221 are also fed to respective inputs of the signal summing unit 308. An output signal from the summer 308 is filtered by the 1+m serially-connected all-pass filters $A_{C1} \ldots A_{C1+m}$, fed through the downstream signal delay unit 422 and attenuated by the downstream attenuator unit 312. An output signal from the attenuator unit 312 is fed to both the input of the signal summing unit 309 and the input of the signal summing unit 310.

The output signal of the signal summing unit 309 is amplified by the downstream signal amplifier unit 204 and subsequently supplied to the front left loudspeaker 210. The output signal of the signal summing unit 310 is amplified by the downstream signal amplifier unit 205 and subsequently supplied to the front right loudspeaker 211.

The signal on the line 224, which is amplified by the signal amplifier unit 208, drives the sub-bass loudspeaker 214 (subwoofer). The sub-bass loudspeaker reproduces low-frequency signal components of the audio signal and does not contribute to the three-dimensional effect of the reproduction, which is produced by the loudspeakers 210-213. Such loudspeaker system is again referred to as a "2-channel surround system".

By summing the left signal and the right signal via the signal summing unit 308, coherent signal components of the left and the right signals are strengthened, whereas incoherent signal components are mitigated. Coherent signal components in the left and the right signals relate to hearing sensations, which are to be perceived in an aural event direction somewhere between the front left and the front right loudspeakers 210, 211. Signal components in the signals on the lines 220, 221, which are substantially identical in amplitude and phase, are to be perceived, for example, "exactly" in the middle between the loudspeakers 210, 211.

By selecting an appropriate distribution for the group delay times (phase shifts) of the all-pass filters, a phase response for the summed signal which is different from that for the single components of the input signals 220, 221 can be formed. Since the summed signal, following transmission via the 1+m all-pass filters $A_1, A_2 \ldots A_{c1+m}$ and attenuation by the attenuator 312 is added to both the signal transmitted via the signal delay unit 412 and to the signal from the signal delay unit 416, e.g., by signal summing units 309,310 as shown in FIG. 4, this signal is also reproduced by the loudspeakers 210 and 211.

From the foregoing, it is seen that the phantom sound source is formed on an axis between the two loudspeakers 210, 211 which corresponds to the impression of the listener and the aural event direction of a direct frontally located sound source. By varying the propagation delay via the 1+m all-pass filters $A_1, A_2 \ldots A_{c1+m}$ and attenuation via the attenuator unit 312, the aural event location of the phantom sound source (the virtual center speaker) can be shifted, for example, to in front of or behind the transverse axis (azimuthal shift) which runs through the two loudspeakers 210, 211.

By transmitting a signal like the summed signal components of signals on the lines 220, 221 over the serially-connected all-pass filters, a delay is imposed to this signal. This delay between the summed signal at the output of the attenuator unit 423 and the respective signal components in the signals on the lines 220, 221 can be compensated for by tuning the signal delay units 412, 416. Notably, the accuracy of the achievable alignment (parallelism) of the phase responses of the transfer functions to the left and the right ears of the listener increases with the number of serially-connected all-pass filters utilized in the signal paths.

In addition, the system 400 in FIG. 4 aligns the phase responses of transfer functions of the left and the right signals on the lines 200, 221 between the front left loudspeaker 210 and the front right loudspeaker 211 and the left and the right ears of the listeners as described above in reference to FIG. 1 (see driver and passenger in FIG. 1). This is achieved by respectively tuning the serially-connected all-pass filters $A_{L1} \ldots A_{L1+i}$ for the signal on the line 220 and by respectively tuning the serially-connected all-pass filters $A_{R1} \ldots A_{R1+i}$ for the signal on the line 221.

The phase responses of the transfer functions of the left and the right signals on the lines 220, 221 between the front left loudspeaker 210 and the left ears of the listeners and between the front right loudspeaker 211 and the right ears of the listeners can be adjusted to become substantially parallel (see diagrams $L_A$ and $R_A$ of FIG. 1). The signal delay units 412, 416 in the signal paths of the left and right signals, respectively, are individually adjustable and therefore serve to substantially congruently render the resulting phase responses of the transfer functions of the signals on the lines 220, 221.

The plurality of tuning options with independently adjustable series of all-pass filters and independently adjustable signal delay units in the signal paths of the left, the right and the summed (virtual center speaker) signals allows for a wide range of setups which can be adjusted for optimizing the localization of audio signals for single or multiple listening positions. While suitable for many types of listening environments, the embodiment in FIG. 4 is particularly instrumental in optimizing the localization of audio signals in the passenger compartment of a motor vehicle (e.g. for the driver and/or the passenger). As becomes clear from the indices used with the references for the all-pass filters of FIG. 4, the overall number of all-pass filters used in the different signal paths as well as the center frequencies and quality factors of each single all-pass filter can be chosen severally or in combination.

Similarly, the aforesaid "tuning" system of all-pass filters, summing units, delay units and attenuator unit can also be applied to the signals on the lines 222, 223 connected to the rear left and the rear right loudspeakers 212, 213, respectively, to optimize the localization of audio signals for one or more listening positions in a rear area of the passenger compartment, as set forth above.

Figure 5:
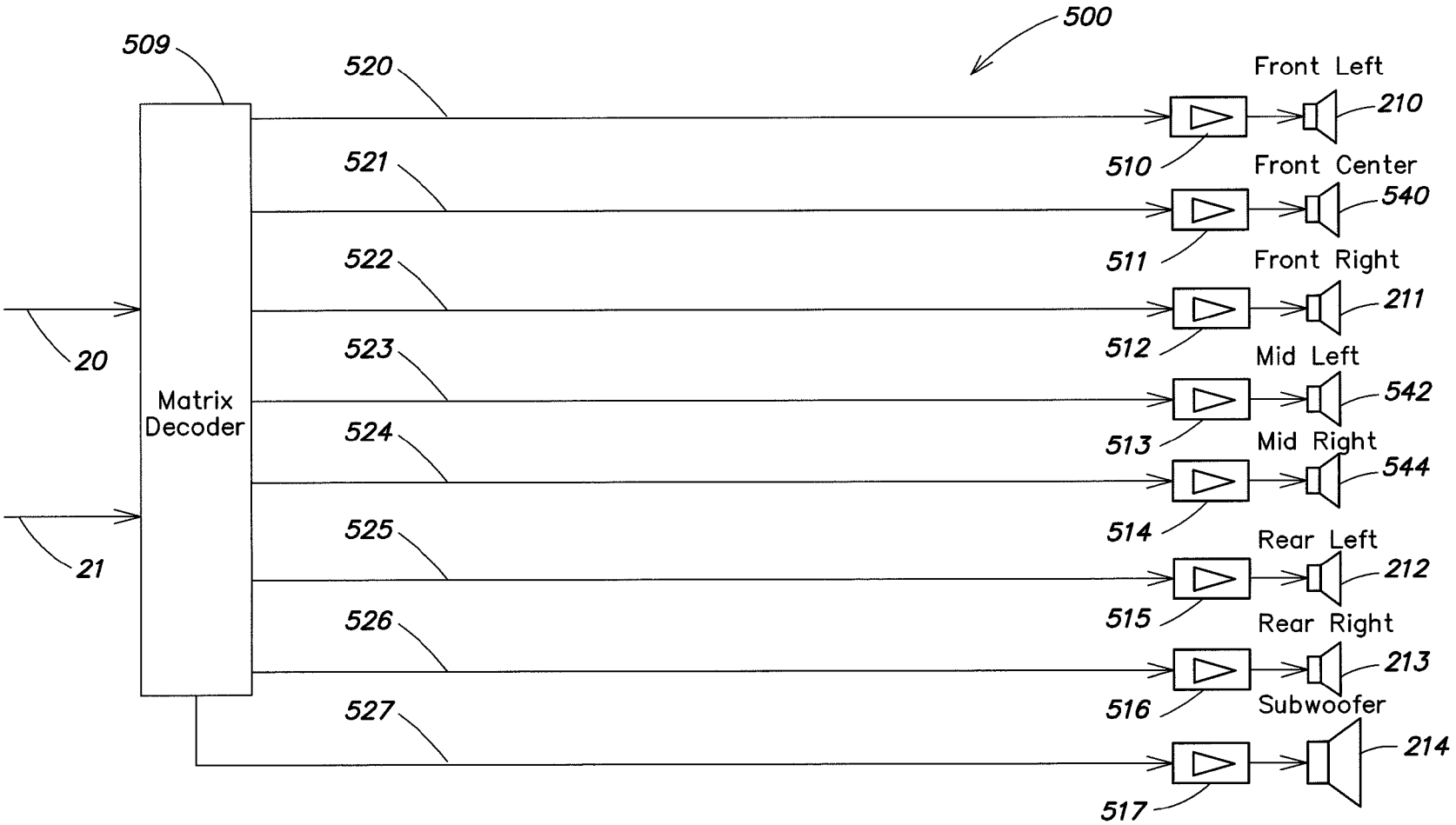
FIG. 5 is a block diagram illustration of one embodiment of a multi-channel active matrix decoding system.

FIG. 5 is a block diagram illustrating one embodiment of a multi-channel active matrix decoding system 500 for stereo input signals, which can provide a dedicated signal for a center speaker. The system 500 includes a matrix decoder 509, a plurality of signal amplifier units 510-517 and a plurality of loudspeakers 210, 540, 211, 542, 544 and 212-214. The matrix decoder 509 receives the stereo input signals 20, 21 (e.g., left and right channel input signals of a two channel stereo signal), and provides a plurality of matrix output signals on lines 520-527.

The signals on the lines 520-527 are amplified by their respective downstream signal amplifier units 510-517 and supplied to their respective loudspeaker. In this embodiment, the output from amplifier 510 drives the loudspeaker 210, which is arranged in a front left portion of a listening room, to the front and to the left of a listening position. The amplifier 512 drives the loudspeaker 211, which is arranged in a front right portion of the listening room, to the front and to the right of the listening position. The amplifier 511 drives the loudspeaker 540, which is arranged in a front center portion of the listening room between the front left and the front right loudspeakers 210, 211.

The loudspeaker 542 is arranged to the left of the listening position, and the loudspeaker 544 is arranged to the right of the listening position. The loudspeaker 212 is arranged to the rear and to the left of the listening position, and the loudspeaker 213 is arranged to the rear and to the right of the listening position. The amplifier 517 drives the sub-bass loudspeaker 214 (subwoofer). The sub-bass loudspeaker reproduces low-frequency signal components of the audio signal and does not contribute to the three-dimensional effect of the reproduction, which is produced by the loudspeakers 210, 540, 211, 542, 544 and 212-213.

Figure 6:
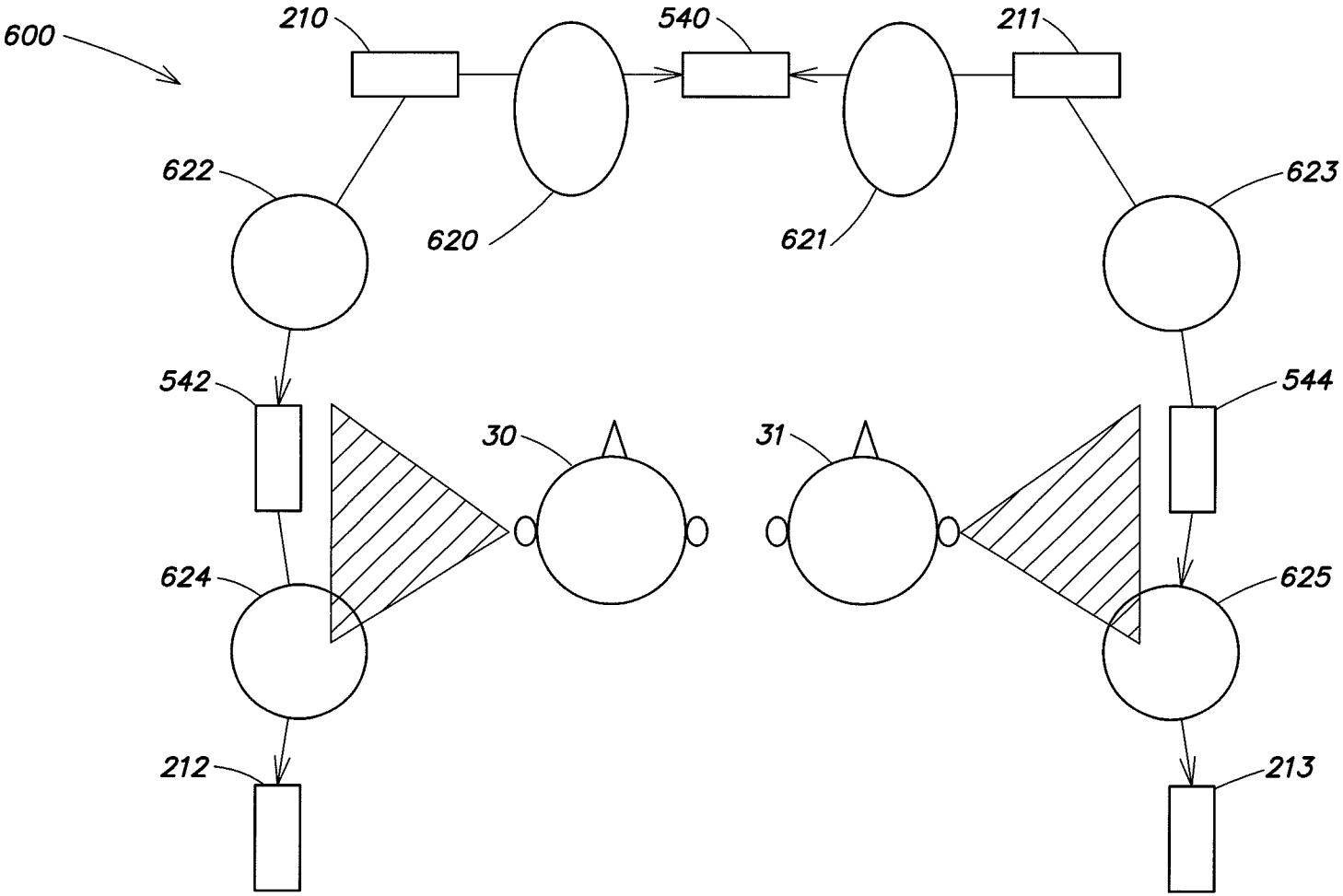
FIG. 6 is a block diagram illustration of one embodiment of an audio system having seven channels.

FIG. 6 is a block diagram illustrating one embodiment of a seven-channel audio system 600 (e.g., configured similar to the system 500 in FIG. 5) is, for example, the interior (e.g., a passenger compartment) of a motor vehicle. Relative to the position of listeners 30, 31, the system 600 includes the front left loudspeaker 210, a front right loudspeaker 211, a center loudspeaker 540 arranged in the center between the front left loudspeaker and the front right loudspeaker (e.g., a front center loudspeaker), a loudspeaker 542 arranged side left (e.g., a mid-left loudspeaker), a loudspeaker 544 arranged side right (e.g., a mid-right loudspeaker), a rear left loudspeaker 212 and a rear right loudspeaker 213. The sub-bass loudspeaker 214 (subwoofer), which can be included in this embodiment, is not shown.

Referring to FIGS. 5 and 6, the matrix decoder 509 includes signal processing blocks 620-625 which generate the signals 520-527 for driving the eight loudspeakers. In such a matrix decoder 509, components of the signal 520 for the front left loudspeaker 210 and components of the signal 522 for the front right loudspeaker 211 generate the signal for the center loudspeaker 540. The signal processing blocks 620, 621, for example, attenuate the amplitude of these signal components on the basis of (i) their spectral distribution and (ii) the desirable three-dimensional sound of the entire audio system. Typical values for this type of attenuation are in the range from approximately 0 dB to −7.5 dB in a matrix decoder.

The signal processing blocks 622-625 delay the signals, which are generated from the two stereo input signals (e.g., signals 20 and 21 in FIG. 5) and drive the loudspeakers, to provide reverberation giving a three-dimensional effect, and raise or lower their level in particular frequency bands to effect a three-dimensional impression. These effects are achieved by using so-called "roll-off and shelving" filters. In this context, raising and lowering frequency ranges of the original stereo input signal and delaying the timing define the three-dimensional sound and the perceived reverberation time. Damping the high frequency components in the signals which are reproduced by the loudspeakers 542, 544, 212 and 213, for example, brings the sound forward in space.

Such a surround system has an adjustable time delay between the audio signals reproduced by the front left loudspeaker 210 and the mid-left loudspeaker 542, also referred to as a "surround loudspeaker". This time delay is produced by the signal processing block 622. Similarly, an adjustable time delay between the front right loudspeaker 211 and the right surround loudspeaker 544 (e.g., the mid-right loudspeaker) is produced by the signal processing block 623.

In addition, such a surround system has a further adjustable time delay between the audio signals reproduced by the mid-left loudspeaker 542 and by the rear left loudspeaker 212. This time delay is produced by the signal processing block 624. Similarly, an adjustable time delay between the mid-right loudspeaker 544 and the rear right loudspeaker 213 is produced by the signal processing block 625.

A matrix decoder, such as the matrix decoder 509 illustrated in FIG. 5, is used to convert signals from for example two input channels (stereo signals) into seven output channels, for example, in order to produce a three-dimensional surround effect in a listening room. These output channels drive loudspeakers arranged at various positions in the listening room. Appropriate processing in an active matrix decoder such as the matrix decoder conditions signals which, for audio purposes, are meant to come from a particular direction, through the matrix decoder, such that when they are reproduced by the loudspeakers in the audio system a listener perceives them to come from the appropriate direction. This stipulates what is known as an aural event direction and possibly what is known as an aural event location for a particular time. Both this aural event direction and this aural event location can change in a dynamic audio signal over time.

In this case, the output signals from a matrix decoder are linear combinations of the two input signals (e.g., a stereo signal). In an active matrix decoder, the coefficients of the linear combinations of the matrix elements are functions of time which change, slowly in comparison with the audible frequencies, in a non-linear fashion. These matrix elements may also be complex functions of frequency and time. Such a decoder is used to stipulate and control the behavior of these coefficients.

A passive matrix decoder has a relatively simple configuration in which all coefficients have fixed values. For example, in one embodiment, an output signal for a left loudspeaker is obtained from an input signal for a left channel multiplied by one, an output signal for a center loudspeaker is obtained from the input signal for the left channel multiplied by 0.7 plus an input signal for a right channel multiplied by 0.7, and an output signal for a right loudspeaker is obtained from the input signal for the right channel multiplied by one.

By contrast, an active matrix decoder has a more complex configuration that is subject to substantial additional demands which influence the signal generated for the center loudspeaker. This is particularly true when the stereo input signal contains a highly directional signal; e.g., a signal component meant to be reproduced by a surround system essentially in the left area of the reproduction space (e.g., a listening room/passenger compartment).

If the input signals do not contain an uncorrelated (non-directional) signal component, channels which do not reproduce the directional signal component have a relatively minimal output signal. For example, a signal generated to appear in a space in between the right loudspeaker and the center loudspeaker should not generate any output signals for the left and the rear loudspeakers in a multi-channel audio system. Similarly, a signal generated to be reproduced in the center should not generate any left or right loudspeaker signal components. Furthermore, the overall output signal from the decoder should be perceived as having substantially the same volume when a directional signal moves in different three-dimensional areas.

Even when the matrix elements of the decoder change to reproduce a directional signal whose direction changes, the total energy in the undirectional signal component of an audio signal needs to be kept relatively constant in each output channel. In addition, the transition between reproduction of the undirectional signal components and reproduction of the directional signal components should be uniform and should not exhibit any shifts in the perceived direction of the audio presentation. All of these requirements are met by the aforesaid matrix decoder, and the signals for the relevant loudspeakers, such as the center loudspeaker in a surround system, are conditioned when necessary. The processing of input signals in the matrix decoder produces a control vector for the directional signal components. This control vector determines how the directional signal's associated signal components of the two input signals in the stereo signal are assessed and, for example, supplied to the center loudspeaker as an input signal when the control vector is pointing forward in a particular direction, inter alia.

Figure 7:
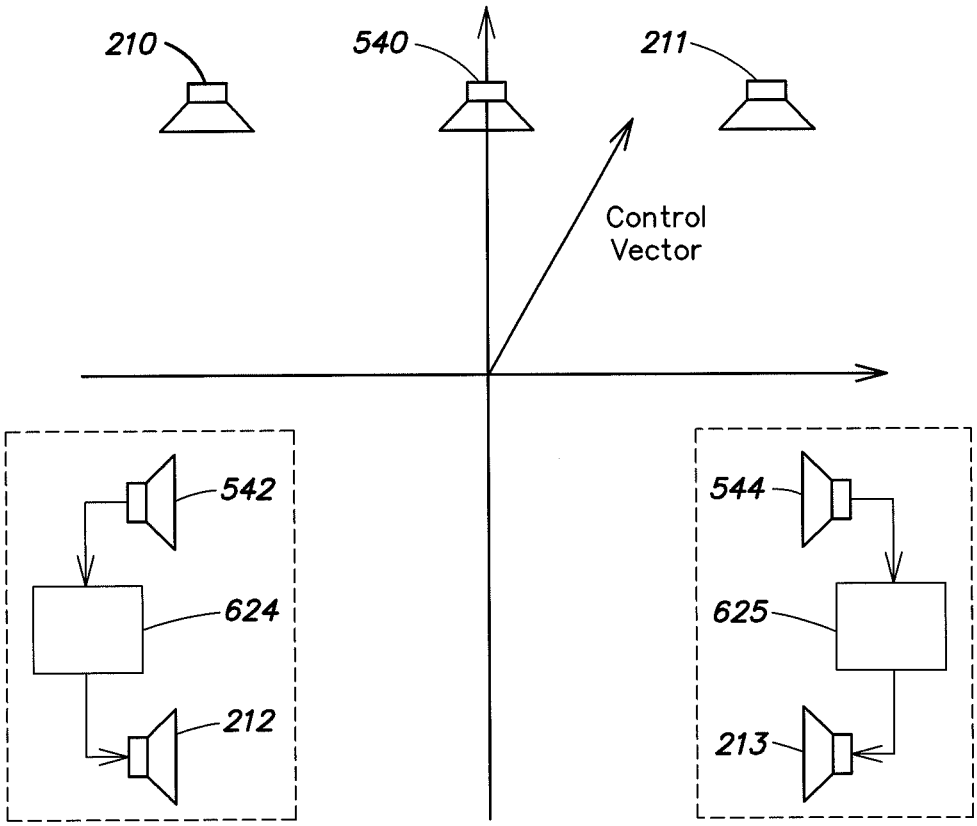
FIG. 7 is a block diagram illustration of one embodiment of a system for producing a control vector in a multi-channel audio system.

FIG. 7 illustrates one of a plurality of possible orientations for a control vector in a seven-channel audio system. The system of FIG. 7 includes the front left loudspeaker 210, the front right loudspeaker 211, the center loudspeaker 540 arranged in between the front left loudspeaker 210 and the front right loudspeaker 211, the left side loudspeaker 542, the right side loudspeaker 544, the rear left loudspeaker 212 and the rear right loudspeaker 213. The system may further include a sub-bass loudspeaker 214 (subwoofer) (not shown). In addition, the system of FIG. 7 includes the signal processing blocks 624, 625, which are described in detail with reference to FIG. 6.

In the example shown in FIG. 7, the control vector of a directional signal component of the stereo input signals processed by the matrix decoder points between the center and the front right loudspeakers 540, 211. Thus, an associated audio signal is perceived from the front and from slightly to the right by a listener. This perception is frequently described by the term "aural event direction". Such a signal is reproduced using signal components of the directional input signal from at least the center loudspeaker 540 and the front right loudspeaker 211 in order to produce the illustrated listener's impression.

The left side loudspeaker 542, the right side loudspeaker 544, the rear left loudspeaker 212 and the rear right loudspeaker 213 reproduce a minimal, if any, signal component of the directional signal. However, the loudspeakers 542, 544, 212 and 213 may reproduce other signal components, for example those of a undirectional signal component of the input signal, at the same time.

A signal digitally processed, for example, via the matrix decoder may produce a relatively unstable overall sound since the control vector can change from one sampling time to the next within the signal. To prevent such instability, the matrix decoder may use a non-linear smoothing filter to transition the control vector from one sampling time to the next. In addition, cases are distinguished to take account of whether the control vector changes on the basis of the input signals into the matrix decoder, for example, from front to rear or for example from left to right. Depending on this change of position, the speed at which a corresponding change in the control vector is produced by the matrix decoder can be increased or decreased within certain limits.

To explain how the signal components of a directional signal are foamed in the matrix decoder from the two input signals in the stereo signal in order to produce an appropriate aural event direction, reference is made to the formation of the signals for the center loudspeaker, which will be omitted and replaced by a phantom sound source as described below. The signal components for the left side loudspeaker 542, the right side loudspeaker 544, the rear left loudspeaker 212 and the rear right loudspeaker 213 are generated, for example, as described above with reference to the matrix decoder.

The signal components for the center loudspeaker (here the phantom sound source) are formed from the two input signals of the stereo signal in the active matrix decoder by multiplying the appropriate matrix elements (coefficients of the linear combinations) by the input signals. In this context, CL (center left) denotes the matrix element for the left input signal for forming the associated output signal component for the center loudspeaker, and CR (center right) denotes the matrix element for the right input signal for forming the associated output signal component for the center loudspeaker.

The matrix elements change (i.e., fluctuate) with the apparent direction of the perceived sound, as determined by the input signals (e.g., as control vector). This apparent direction—the aural event direction—is determined by the ratio of the amplitudes of the input signals. For example, a degree of control in a left/right (l/r) direction is determined by a ratio of amplitude of an input signal in a left stereo channel Lin to amplitude of an input signal in a right stereo channel Rin. Similarly, the degree of control in a front/rear (c/s—center/surround) direction is determined by a ratio of a sum of the amplitudes of the left and right input signals to the difference in the amplitudes of the left and right input signals. The control directions are shown below as angles in degrees, where "lr" denotes an angle in the left/right direction and "cs" denotes an angle in the front/rear direction.

$$lr=90\text{ degrees}-\arctan(|Lin|/|Rin|)$$

$$cs=90\text{ degrees}-\arctan(|Lin+Rin|/|Lin-Rin|)$$

Where both lr and cs are zero, the associated input signals are nondirectional; i.e., the two input channels have no correlation. Where the input signals (the two stereo signals) have been generated from a single directional signal, the two direction control values correspond to non-zero values. For example, an input signal cannot be oriented on the left and to the center at the same time. Where there is a single directional signal in the input signals, the sum of the two direction control values lr and cs is equal to 45 degrees. Where the input signals contain nondirectional signal components together with a highly directional signal component, the sum of the absolute values of the direction control values is:

$$|lr|+|cs|\Leftarrow 45\text{ degrees}$$

The following example illustrates how the matrix elements CL and CR for the center loudspeaker signal are calculated in the matrix decoder when a directional signal is moved from left to center. An important feature of the center loudspeaker output signal is that it needs to diminish evenly when direction is controlled from the center to the left or right. This decrease is controlled by the magnitude of (|Lin|/|Rin|)=l/r. The direction control value ranges from zero degrees for a signal oriented completely to the left to 45 degrees for a signal oriented substantially in the center (lr=90 degrees−arcan (|Lin|/|Rin|)). For the matrix elements CL and CR in the matrix decoder, the equation is as follows:

$$\sin(2lr)=(CL*\cos(lr)+CR*\sin(lr))$$

Further, the total level of the output signal should not be altered by the direction control. Therefore, the sum of the squares of the matrix elements should be the value 1:

$$CL^2+CR^2=1$$

Using the aforesaid conditions, the matrix elements CR and CL can be determined as follows:

$$CR=\sin(lr)*\sin(2lr)-\cos(lr)*\cos(2lr)$$

$$CR=\cos(lr)*\sin(2lr)+\sin(lr)*\cos(2lr)$$

The signal components for the center loudspeaker are formed from the two input signals (Lin and Rin) in the matrix decoder by multiplying the appropriate matrix elements CR and CL (coefficients of the linear combinations) by the input signals Rin and Lin. It should be noted that the matrix elements of the matrix decoder for the two front loudspeakers and the right and the left side loudspeakers are likewise derived from the control vector or the aural event direction.

The two remaining signals for the rear right and the rear left loudspeakers are derived directly from the signals for the right and the left side loudspeakers by a time delay (see FIG. 6) via appropriate signal processing blocks (see signal processing blocks 624 and 625 in FIG. 6). The levels in determined frequency bands may be increased or decreased, which augments the three-dimensional effect in surround systems, by using the roll-off and the shelving filters in the signal processing blocks 624, 625. For this, these roll-off and shelving filters are driven by the control vector described above.

The control vector is also used to drive the roll-off and shelving filters in the signal processing blocks 622, 623. When the control vector is "directed a long way forward", for example, these filters can be used to bring the overall sound image forward by virtue of these filters lowering the high-frequency signal components which are reproduced by the left and the right side loudspeakers and the rear left and the rear right loudspeakers in the surround system.

In the present embodiment, the matrix decoder not only processes the two-channel stereo signals as input signals, as described above, but also processes 5.1 surround sound input signals. A five-channel 5.1 input signal has separate input signals for the front left loudspeaker, the front right loudspeaker, the left side loudspeaker, the right side loudspeaker, and the center loudspeaker. As in the case of two stereo input signals, the matrix decoder derives seven loudspeaker signals such as signals 520-527 of FIG. 5 from the input signals for the front left loudspeaker and the front right loudspeaker.

The signal for the center loudspeaker which is derived in this process and the signal for the center loudspeaker which comes from the input signal are used to form the signal which is ultimately used for the center loudspeaker. Similarly, the ultimate signals for the left and the right side loudspeakers are derived from the signals formed by the matrix decoder and from the relevant signals from the input signals. The signals for the rear left and the rear right loudspeakers correspond directly to the signals formed by the matrix decoder.

Figure 8:
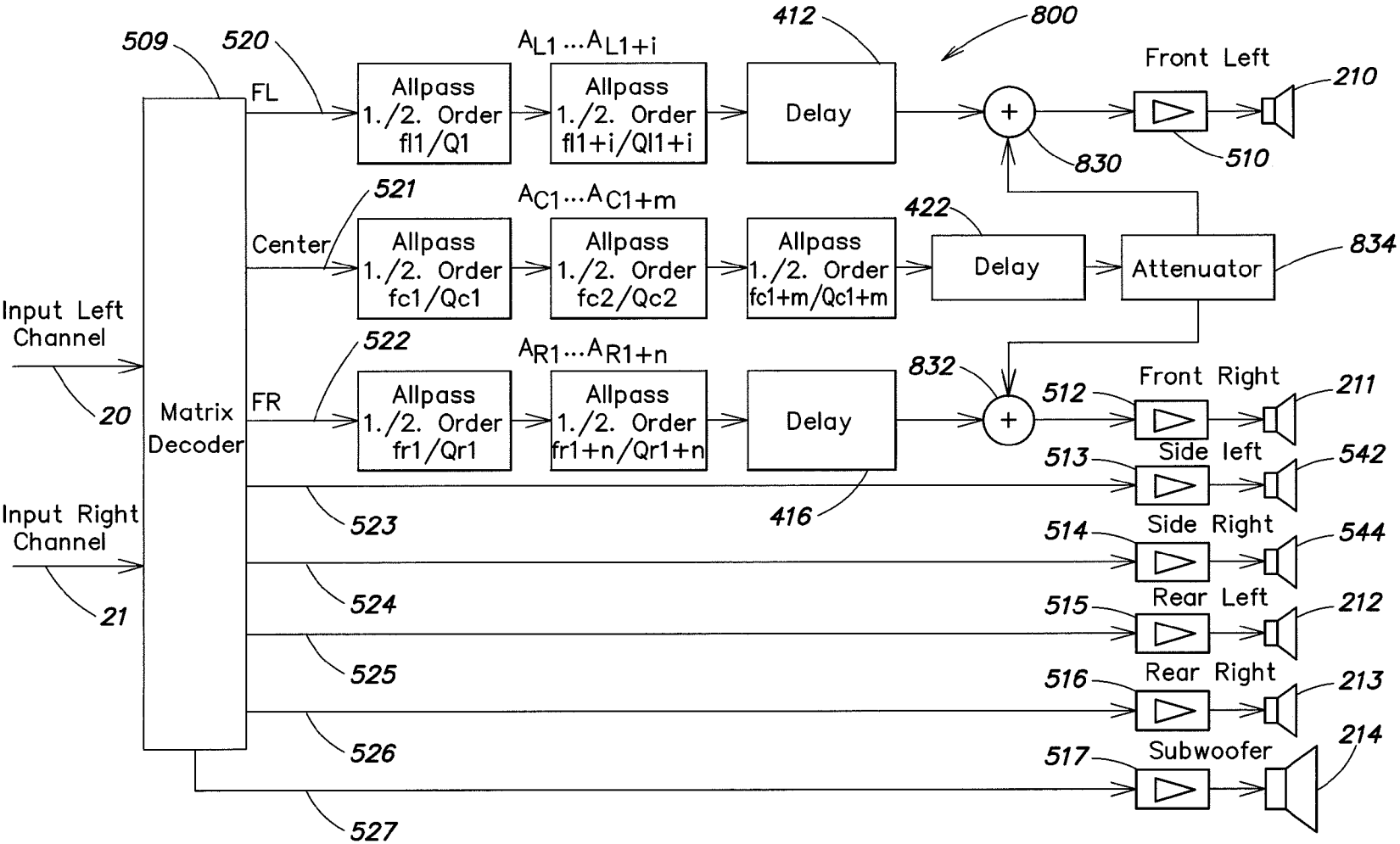
FIG. 8 is a block diagram illustration of one embodiment of a multi-channel active matrix decoding system.
Figure 9:
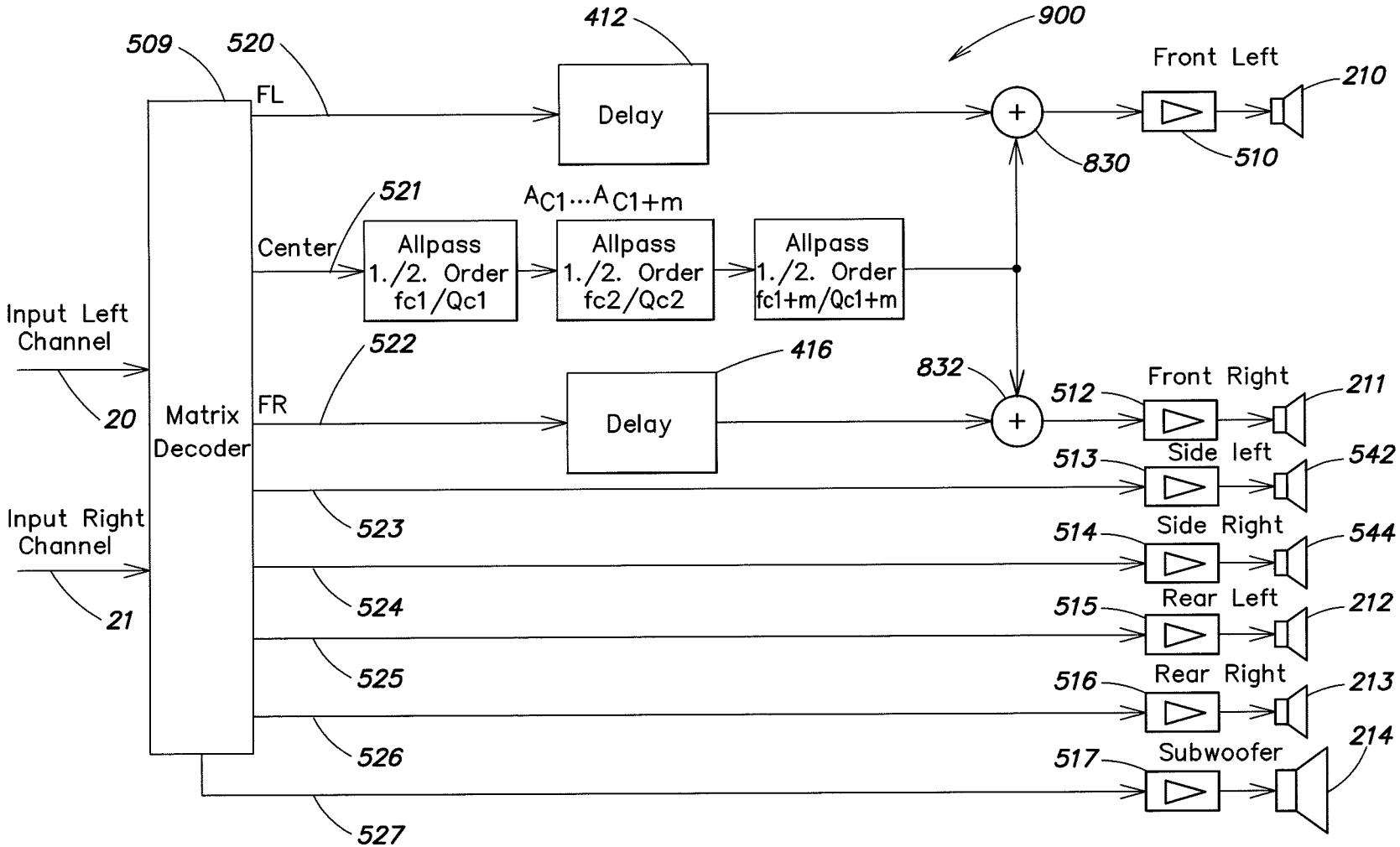
FIG. 9 is a block diagram illustration of another embodiment of a multi-channel active matrix decoding system.

Rather than providing a virtual center speaker by using a signal summed up from left and right signals (see FIGS. 2, 3 and 4), the systems in FIGS. 8 and 9 use a center speaker signal to form signals for a virtual center speaker. FIG. 8 is a block diagram of one embodiment of a multi-channel audio system 800 that aligns phase responses of transfer functions between the left and the right loudspeakers and the left and the right ears of the listeners and generates a virtual sound source as a substitute for a center loudspeaker. The system 800 includes the matrix decoder 509, the signal amplifier units 510, 512-517 and the loudspeakers 210-211, 542, 544 and 212-214. The matrix decoder 509 receives the stereo input signals 20, 21 (e.g., left and right channel input signals of a two channel stereo signal), and provides a plurality of signal outputs for the signals 520-527. The system 800 shown in FIG. 8 also includes a signal summing unit 830, a signal summing unit 832, the 1+i serially-connected all-pass filters $A_{L1}, A_{L2} \ldots A_{L1+i}$, the 1+n all-pass filters $A_{R1}, A_{R2} \ldots A_{R1+n}$, the 1+m all-pass filters $A_{C1}, A_{C2} \ldots A_{C1+m}$, the signal delay units 412, 416 and 422, and attenuator unit 834.

In this system, the loudspeaker 542 is arranged to the left hand side of the listening position and the loudspeaker 544 is arranged to the right hand side of the listening position. The loudspeaker 212 is arranged to the left and to the rear of the listening position, and the loudspeaker 213 is arranged to the right and to the rear of the listening position.

The matrix output signal on the line 527 is amplified by the signal amplifier unit 517, and the amplified signal drives the sub-bass loudspeaker 214 (subwoofer). In this system, the sub-bass loudspeaker is used for reproducing low-frequency signal components of the audio signal and does not contribute to the spatial effect of the reproduction, which is produced by the other loudspeakers 210-213, 542 and 544 in the system.

The matrix output signal on the line 520 is generated, for example, as set forth above with reference to FIG. 5. In contrast to the system shown in FIG. 5, however, this output signal 520 is not supplied directly to the amplifier unit to drive the front left loudspeaker 210 but rather the signal on the line 520 is routed from the matrix decoder 509, through the serially-connected all-pass filters $A_{L1}, A_{L2} \ldots A_{L1+i}$ and the downstream signal delay unit 412, to the input of the signal summing unit 830.

The matrix output signal on the line 522 is also generated, for example, as set forth above with reference to FIG. 5. In contrast to the system shown in FIG. 5, however, this output signal 522 is not supplied directly to the amplifier unit to drive the front right loudspeaker 211. Rather, the signal on the line 522 is routed from the matrix decoder 509, through the serially-connected all-pass filters $A_{R1}, A_{R2} \ldots A_{R1+n}$ and the downstream signal delay unit 416, to the input of the signal summing unit 832.

The center speaker matrix output signal on the line 521 is generated, for example, as set forth above with reference to FIG. 5. In contrast to the system shown in FIG. 5, however, this output signal on the line 521 is not supplied directly to an amplifier unit to drive the front center loudspeaker. Rather, in the embodiment in FIG. 8, the signal on the line 521 is routed from the matrix decoder 509, through the serially-connected all-pass filters $A_{C1}, A_{C2} \ldots A_{C1+m}$ and the downstream signal delay unit 422, to the downstream attenuator unit 834 before being supplied to both the input of the signal summing unit 830 and to the input of the signal summing unit 832.

The signal summing unit 830 adds the filtered and delayed version of the signal on the line 520 and the filtered, delayed and attenuated signal version of the signal on the line 521, and outputs a summed signal to the downstream amplifier unit 510 to drive the front left loudspeaker 210. In this system, this loudspeaker 210 corresponds to the front left loudspeaker in a multi-channel surround system. The signal on the line 520 generated by the matrix decoder 509 for the front left loudspeaker and the signal on the line 521 generated by the matrix decoder 509 for the center loudspeaker are added after being processed as described above and are reproduced via the loudspeaker 210 together as a summed signal amplified by the downstream amplifier unit 510.

The signal summing unit 832 sums the filtered and delayed version of the signal on the line 522 and the filtered, delayed and attenuated version of the signal on the line 521, and outputs a summed signal to the downstream amplifier unit 512 to drive the front right loudspeaker 211. In this system, this loudspeaker 211 corresponds to the front right loudspeaker in a multi-channel surround system. The signal on the line 522 generated by the matrix decoder 509 for the front right loudspeaker and the signal on the line 521 generated by the matrix decoder 509 for the center loudspeaker are added after being processed as described and are reproduced via the loudspeaker 211 together as a summed signal amplified by the amplifier unit 512.

As a result of the foregoing, the center signal is reproduced by the front left loudspeaker 210 and by the front right loudspeaker 211 as a function of the filtered, delayed and attenuated version of the signal on the line 521. That is, this phantom sound source or virtual center speaker replaces the center loudspeaker 540 in the system 500 illustrated in FIG. 5 using the front left and the front right loudspeakers 210, 211. Localizability, also referred to as localization, refers to the perceived location of an aural event that arises from the superimposition of stereo signals, in the present example the processed signal components of signal on the line 521 in the loudspeakers 210, 211.

The localizability of phantom sound sources generated by stereophonic audio signals is dependent on several parameters. These are, inter alia, a delay time difference between arriving audio signals, a level difference between arriving audio signals, an interaural level difference for an arriving sound between the right and the left ears, an interaural delay time difference for an arriving sound between the right and the left ears, and what is known as a head related transfer function. In addition, the localizability of phantom sound sources is dependent on determined frequency bands with a raised level, the three-dimensional localization of direction at the front, at the top and at the rear being dependent solely on the level of the sound in these frequency bands, without there simultaneously being a delay time difference or a level difference between the audio signals.

The essential parameters for three-dimensional audio perception are an interaural time difference (ITD), an interaural intensity difference (IID), and a head related transfer function (HRTF). The ITD results from the delay time differences between the right and the left ears for an audio signal with side incidence and can assume orders of magnitude of up to 0.7 milliseconds. If the speed of sound is assumed to be 343 m/s, this corresponds to a difference of approximately 24 centimeters in the path of an audio signal and hence to the anatomical circumstances of a human listener. In this regard, the hearing evaluates the psychoacoustic effect of the law of incidence of the first wave front. At the same time, it can be seen for an audio signal which is incident on the side of the head that sound damping by the head means that the sound pressure at the ear which is at a greater physical distance is lower (IID).

It is known that a shape of a pinna (i.e., a visible part of an ear) can be represented by a transfer function for received audio signals into the auditory canal. The pinnae (e.g., the pinna of the right and the left ears) therefore have a characteristic frequency and phase response for a given angle of incidence of an audio signal. This characteristic transfer function is convoluted with the sound that enters the auditory canal, and makes a substantial contribution to the capability of three-dimensional hearing. In addition, the sound that reaches the ears is also altered by other influences. These alterations are brought about by the ear's surroundings; e.g., the anatomy of the body.

Sound traveling from a source (e.g., a loudspeaker) to ears of a listener is typically altered en route via, for example, general spatial acoustics, shadowing by the head, and/or reflections from the shoulders or from other parts of the body. A characteristic transfer function which accounts for all of these influences is referred to as the head related transfer function (HRTF) and describes the frequency dependency of the transmission of sound. HRTF's therefore describe the physical features that are used by the auditory system for localizing and perceiving audible sound sources. Additionally, there is a dependency on horizontal and vertical angles of incidence of the sound. In the simplest form of stereo presentation, correlated signals (e.g., the signal components for the signal on the line 521) are presented using two physically separate loudspeakers (e.g., the front left and the front right loudspeakers 210, 211) such that the phantom sound source forms between these loudspeakers. The term 'phantom sound source' is used because superimposing and summing two or more audio signals generated by different loudspeakers can provide an aural event that is perceived at the location where there is no actual loudspeaker.

Where two loudspeakers in a stereo system are used to reproduce two correlated signals at the same level and with equal phase, the sound source (i.e., the phantom sound source) is perceived as centered between the two loudspeakers where a listener is in a listening position that is equidistant to each of the loudspeakers. This is the case for the processed signal on the line 521, since it is fed in identical form to both loudspeakers 210 and 211 (see signal summing units 830 and 832). The serially-connected all-pass filters $A_{L1}, A_{L2} \ldots A_{L1+i}$ and the serially-connected all-pass filters $A_{R1}, A_{R2} \ldots A_{R1+n}$ substantially align the phase responses of the transfer functions between the front left and the front right loudspeakers 210 and 211 and the left and the right ears of the listeners for the left and the right signals on the lines 520, 522, respectively, (e.g. a driver and a passenger in the passenger compartment of a motor vehicle) as can be seen from diagrams $L_A$ and $R_A$ of FIG. 1.

The number of all-passe filters used in the different signal paths as well as the center frequencies and the quality factors of each all-pass filter can be individually chosen. This is achieved by respectively tuning of the serially-connected all-pass filters $A_{L1} \ldots A_{L1+i}$ for the signal on the line 520, and by respectively tuning of the serially-connected all-pass filters $A_{R1} \ldots A_{R1+n}$ for the signal 522. As a result the phase responses of the transfer functions of the left and the right signals on the lines 520 and 522 between the front left loudspeaker 210 and the left ears of the listeners and between the front right loudspeaker 211 and the right ears of the listeners can be adjusted to become substantially parallel.

Since the serially-connected all-pass filters $A_{L1} \ldots A_{L1+i}$, the serially-connected all-pass filters $A_{R1} \ldots A_{R1+n}$ and the serially-connected all-pass filters $A_{C1} \ldots A_{C1+m}$ can be severally configured, different overall signal delays in the different signal paths can occur by the respective signal processing. The additional signal delay units 412, 416 and 422 are individually adjustable and to compensate for undesired signal delays imposed by the respective all-pass filters. Furthermore, the signal delay units 412, 416 can also be used to render the resulting parallelized phase responses of the transfer functions of the signals on the lines 520, 522 substantially congruent to optimize the localization of sound for a single listener.

The plurality of tuning options afforded by the independently adjustable series of all-pass filters and independently adjustable signal delay units in the signal paths of the left, the right and the virtual center speaker signals provides a wide range of setups which can be adjusted for optimizing the localization of audio signals for single or multiple listening positions. While being applicable to a multitude of listening environments, the system 800 in FIG. 8 is configured in view of the localization of audio signals for a passenger compartment of a motor vehicle (e.g., for the driver or the driver and the passenger).

Each all-pass filter, in contrast to other filters (such as low-pass, high-pass, bandpass and band-rejection filters), has a constant gain and thus a constant absolute-value frequency response for all frequencies. However, the all-pass filters have a frequency-dependent phase shift (non-linear phase response) which can be used for signal delay or phase correction. The 1+i all-pass filters $A_{L1}$, $A_{L2}$ . . . $A_{L1+i}$, the 1+n all-pass filters $A_{R1}$, $A_{R2}$ . . . $A_{R1+n}$ and the 1+m all-pass filters $A_{C1}$, $A_{C2}$ . . . $A_{C1+m}$ can be configured as first-order all-pass filters. In the present embodiments, however, these filters are configured as second-order all-pass filters.

The transfer function H(z) for a second-order all-pass filter is given by:

$$H(z)=(z^2-(w_0/Q)*z+w_0^2)/(z^2+(w_0/Q)*z+w_0^2)$$

where, z is the complex variable δ+jw, and Q is the quality factor, and $f_0=w_0/2$ is the center frequency of the filter. The phase shift of the all-pass filter as a function of frequency is dependent on the value of the quality factor Q. By varying the Q value of the filter, it is possible to vary the bandwidth of the frequency components of the signals which are phase-shifted by the filter.

In some embodiments, the filters can be implemented with high Q values that have a characteristic of abrupt phase variation in the phase within the central frequency band around the center frequency $f_0$. In this embodiment, for example, only the frequency components of a narrow frequency band around the center frequency $f_0$ have any significant phase shift or propagation delay, which is also referred to as a "group delay time". The most frequency-independent group delay time possible is important in acoustics, particularly for natural audio reproduction. Such a frequency-independent group delay time can be achieved by digitally implementing the all-pass filters with a high quality value Q, which are used in the embodiment in FIG. 8.

By concatenating a corresponding large number of the all-pass filters (as shown in FIG. 8), it is possible to achieve a phase shift or propagation delay for wideband signals, such as the signals on the lines 520-522 illustrated in FIG. 8, which has a desired (similar) phase response over approximately the entire bandwidth of the signals. This means that the 1+i all-pass filters $A_{L1}$, $A_{L2}$ . . . $A_{L1+i}$, the 1+n all-pass filters $A_{R1}$, $A_{R2}$ . . . $A_{R1+n}$ and the 1+m all-pass filters $A_{C1}$, $A_{C2}$ . . . $A_{C1+m}$ can be used to set the propagation delays for the signals on the lines 520-522 such that they are substantially similar over a wide bandwidth through appropriate choice of the filter parameters.

Advantageously, the audibility of group delay time changes has a particular perceptibility threshold. The perceptibility threshold for group delay time changes for an audio signal is approximately 3.2 ms for frequencies of 500 Hz, approximately 2 ms for frequencies of 1 kHz, approximately 1 ms for frequencies of 2 kHz, approximately 1.5 ms for frequencies of 4 kHz and approximately 2 ms for frequencies of 8 kHz. That is, the desirable propagation delay for audio signals, which is relatively constant over a wide bandwidth, can be achieved where the perceptibility thresholds for group delay time changes are not exceeded in the design of the relevant all-pass filters. Furthermore, the group delay time is chosen such that it is not necessarily constant over frequency. Therefore, an arbitrarily adjustable target frequency response for the group delay time can be provided.

The signals on the lines 520 and 522, for the front left loudspeaker 210 and the front right loudspeaker 211 in FIG. 8, have the same respective propagation delay where the 1+i all-pass filters $A_{L1}$, $A_{L2}$ . . . $A_{L1+i}$ and the 1+n all-pass filters $A_{R1}$, $A_{R2}$ . . . $A_{R1+n}$ each have identical parameters for the center frequency f and the quality value Q and i=n, as in the present case:

$$f_{L1}=f_{R1}, f_{L2}=f_{R2} \ldots f_{L1+i}=f_{R1+n} \text{ and}$$

$$Q_{L1}=Q_{R1}, Q_{L2}=Q_{R2} \ldots Q_{L1+i}=Q_{R1+n}$$

By contrast, the number of the 1+m all-pass filters $A_{C1}$, $A_{C2}$ . . . $A_{C1+m}$ for the signal on the line 521 from the matrix decoder 509 can still differ from the number of the two arrays of 1+i and 1+n all-pass filters for the signals on the lines 520, 522. That is, the value m for the array of 1+m all-pass filters and/or the center frequencies and the quality values of the individual all-pass filters can differ from the number and/or the center frequencies and the quality values of the two other arrays of all-pass filters. Therefore, for example, it is possible to select a different spectral distribution for the group delay times of the all-pass filters for the signal on the line 821 from that for the two arrays of 1+i and 1+n all-pass filters.

The overall propagation delay generated by the multiplicity 1+m of all-pass filters $A_{C1}$, $A_{C2}$ . . . $A_{C1+m}$ for the signal on the line 521 from the matrix decoder 509 may differ from the propagation delay for the signals on the lines 520 and 521. However, since the signal on the line 521 from the matrix decoder 509 is added to both the signal on the line 520 transmitted via the 1+i all-pass filters $A_{L1}$, $A_{L2}$ . . . $A_{L1+i}$ and to the signal on the line 522 transmitted via the 1+n all-pass filters $A_{R1}$, $A_{R2}$ . . . $A_{R1+n}$ following transmission via the 1+m all-pass filters $A_{C1}$, $A_{C2}$ . . . $A_{C1+m}$ (see signal summing units 830, 832 shown in FIG. 8), it is reproduced with the same respective propagation delay via the loudspeakers 210, 211.

This means that the phantom sound source is involved such that it is formed on an axis between the two loudspeakers 210, 211, which corresponds to the listener's impression and the aural event direction of a frontal signal. By appropriately varying the propagation delay via the 1+n all-pass filters $A_{C1}$, $A_{C2}$, $A_{C1+m}$ and/or adjusting via the signal delay unit 422, the aural event location of the phantom sound source (the virtual center speaker) may be shifted, for example to in front of or behind the transverse axis (azimuthal shift) which runs through the two loudspeakers 210, 211.

A similar effect is also achievable by a uniform variation of the signal on the line 520 transmitted via the 1+i all-pass filters $A_{L1}$, $A_{L2}$ . . . $A_{L1+i}$ and the signal on the line 522 transmitted via the 1+n all-pass filters $A_{R1}$, $A_{R2}$ . . . $A_{R1+n}$. The system may be optimized for a single listening position (e.g., the driver position) by respectively independently adjusting of all three chains of all-pass filters $A_{L1}$, $A_{L2}$ . . . $A_{L1+i}$, $A_{R1}$, $A_{R2}$ . . . $A_{R1+n}$ and $A_{C1}$, $A_{C2}$ . . . $A_{C1+m}$. The attenuator unit 834 attenuates the processed signal (e.g., the filtered and delayed version of the signal on the line 521) before it is fed to the signal summing units 830, 832. The signal components symmetrically fed to the left and the right loudspeakers via the lines 520, 522, respectively, can be reduced in level, which can create an effect that the virtual center speaker produced appears farther away from a respective listener.

Variations of the propagation delay via the 1+i all-pass filters $A_{L1}$, $A_{L2}$ . . . $A_{L1+i}$ and the 1+n all-pass filters $A_{R1}$, $A_{R2}$ . . . $A_{R1+n}$ further allows the incidence of the first sound front of the signals on the lines 520, 522 for a listener to be altered. Therefore, the sound of the audio signals reproduced by the loudspeakers 210, 211 each can be altered within a wide range. For example, optimum sound reproduction for the interior of a motor vehicle can be achieved in such a way that centrally located hearing sensations in stereo or multichannel audio signals are substantially perceived as centrally located hearing sensations substantially independent of the seating position of the respective listeners.

Similarly, a respective system for the alignment of phase responses of the transfer function may be applied to the signal paths of the rear left and the rear right loudspeakers 212, 213 of FIG. 8 to optimize the localization of an audio signal specifically for one or more seating positions of the listeners in a rear area of a passenger compartment (not shown in FIG. 8). Also, a respective system for the alignment of phase responses of transfer function may be applied to the signal paths of the left side and the right side loudspeakers 542, 544 of FIG. 8 in order to provide more tuning options for the optimization of sound localization in both the front and the rear seating positions.

FIG. 9 is a block diagram showing one embodiment of a multi-channel audio system 900 for (i) aligning phase responses of transfer functions between left and right loudspeakers and left and right ears of listeners, and (ii) generating a virtual sound source as a substitute for a center loudspeaker. The audio system 900 includes the matrix decoder 509, the signal amplifier units 510 and 512-517, and the loudspeakers 210-211, 542, 544 and 212-214. The matrix decoder 509 receives the stereo input signals 20, 21 (e.g., left and right channel input signals of a two channel stereo signal). The matrix decoder 509 also includes a plurality of signal outputs on the lines 520-527. The system 900 also includes the signal summing unit 830, the signal summing unit 832, the 1+m all-pass filters $A_{C1}, A_{C2} \ldots A_{C1+m}$, and the signal delay units 412, 416.

The matrix decoder 509 takes the stereo input signals 20, 21 and generates the matrix signals 520-527. The signals 523-527 are amplified by respective downstream signal amplifier units 513-517 and drive respective loudspeakers 542, 544 and 212-214 in the multi-channel audio system 900. The loudspeaker 542 is arranged to the left hand side of a listening position, and the loudspeaker 544 is arranged to the right hand side of the listening position. The loudspeaker 212 is arranged to the left and to the rear of the listening position, and loudspeaker 213 is arranged to the right and to the rear of the listening position.

The matrix output signal on the line 527, which is amplified by the signal amplifier unit 517, drives the sub-bass loudspeaker 214 (subwoofer). The sub-bass loudspeaker 214 is used for reproducing low-frequency signal components of the audio signal and does not contribute to the spatial effect of the reproduction, which is produced by the loudspeakers.

The matrix output signal on the line 520 is generated, for example, as set forth above with reference to FIG. 5. In contrast to the system of FIG. 5, however, this output signal is not supplied directly to the amplifier unit to drive the front left loudspeaker 210. Rather, in the embodiment in FIG. 9, the output signal on the line 520 is routed from the matrix decoder 509, through the downstream signal delay unit 412, to an input of the signal summing unit 830.

The matrix output signal on the line 522 is also generated, for example, as set forth above with reference to FIG. 5. In contrast to the system shown in FIG. 5, however, this output signal is not supplied directly to the amplifier unit to drive the front right loudspeaker 211. Rather, in the embodiment in FIG. 9, the output signal on the line 522 is routed from the matrix decoder 509, through the signal delay unit 416, to an input of the signal summing unit 832.

The center speaker output signal on the line 521 is generated, for example, as set forth above with reference to FIG. 5. In contrast to the system shown in FIG. 5, however, this output signal is not supplied to an amplifier unit to drive the front center loudspeaker 540. Rather, in the embodiment in FIG. 9, the output signal on the line 521 is routed from the matrix decoder 509, through the 1+m of serially-connected all-pass filters $A_{C1}, A_{C2} \ldots A_{C1+m}$, to both an input of the signal summing unit 830 and an input of the signal summing unit 832.

The signal summing unit 830 sums the delayed version of the output signal on the line 520 and the filtered version of the output signal on the line 521, and outputs a summed signal to the downstream amplifier unit 510 to drive the front left loudspeaker 210. In other words, the signal on the line 520 generated by the matrix decoder 509 for the front left loudspeaker 210 and the signal on the line 521 generated by the matrix decoder 509 for the center loudspeaker (e.g., the virtual center loudspeaker) are added after being processed as described above, and are audibly reproduced via the loudspeaker 210 as a summed signal amplified by the downstream amplifier unit 510.

The signal summing unit 832 sums the delayed version of the output signal on the line 522 and the filtered version of the output signal on the line 521, and outputs a summed signal to the downstream amplifier unit 512 to drive the front right loudspeaker 211. In other words, the signal on the line 522 generated by the matrix decoder for the front right loudspeaker 211 and the signal on the line 521 generated by the matrix decoder for the center loudspeaker (e.g., the virtual center loudspeaker) are added after being processed as described above and are audibly reproduced via the loudspeaker 211 as a summed signal amplified by the downstream amplifier unit 512.

As a result, the signal on the line 521 for the virtual center loudspeaker is reproduced both by the front left and the front right loudspeakers 210, 211. That is, the phantom sound source or the virtual center speaker replaces the center loudspeaker in the system shown in FIG. 5, which is produced by the superimposed sound signals generated by the two loudspeakers 210, 211.

The 1+m serially-connected all-pass filters $A_{C1}, A_{C2} \ldots A_{C1+m}$ delay the center loudspeaker signal as it travels from the matrix decoder to the signal summing units 830, 832. This delay can be compensated for by respectively tuning the signal delay units 412, 416. The signal delay units 412, 416 may be adjusted to equally delay their associated input signals to compensate for the delay imposed by the series of all-pass filters $A_{C1}, A_{C2} \ldots A_{C1+m}$. Where, however, the system 900 is fine-tuned for a specific listening position (e.g. the position of the driver or the passenger in a passenger compartment), the signal delay units 412, 416 may be adjusted to effect differing delays for the signals front left and front right paths.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. For example, the mixer, the matrix decoder, the all-pass filter(s), the delay unit(s), the amplifier unit(s), the attenuator unit, and/or the summer unit(s) can be included in a digital or an analog signal processing unit (or "processor"). Therefore, such modifications to the inventive concept are intended to be covered by the following claims.

What is claimed is:

1. An audio system for enhancing localization of sound perceived by a listener in a listening position, the system comprising:

two loudspeakers arranged distant from each other and from the listening position, where the sound is transmitted from each of the loudspeakers to the listening position according to a respective transfer function, and where the transfer functions have different phase responses over frequency; and a signal processing unit that is connected upstream of the loudspeakers and receives two electrical input signals to be radiated as respective sound signals by the two loudspeakers, where the signal processing unit includes a phase shifter unit that phase-shifts at least one of the electrical input signals such that a difference in phase responses is substantially constant over frequency in a frequency band audible to a human listener, where the phase shifter unit comprises at least one of an all-pass filter and two delay units, where one of the two delay units is supplied with one of the two electrical input signals, and where the other one of the two delay units is supplied with the other one of the two electrical input signals, where the phase shifter unit further comprises at least one all-pass filter that is supplied with one of the first and the second additional electrical signals, and provides an output signal; and where the phase shifter unit further comprises two summers, where one of the summers adds the output signal of the at least one all-pass filter and one of the two electrical input signals and outputs a first drive signal to one of the two loudspeakers, and where the other one of the summers adds the output signal of the at least one all-pass filter and the other one of the two electrical output signals and outputs a second drive signal to the other one of the two loudspeakers.

2. The system of claim 1, where the phase shifter unit further comprises a delay unit connected in series with the at least one all-pass filter supplied.

3. The system of claim 1, where the phase shifter unit further comprises an attenuator unit connected in series with the at least one all-pass filter.

4. An audio system for enhancing localization of sound perceived by a listener in a listening position, the system comprising:

two loudspeakers arranged distant from each other and from the listening position, where the sound is transmitted from each of the loudspeakers to the listening position according to a respective transfer function, and where the transfer functions have different phase responses over frequency; and a signal processing unit that is connected upstream of the loudspeakers and receives two electrical input signals to be radiated as respective sound signals by the two loudspeakers, where the signal processing unit includes a phase shifter unit that phase-shifts at least one of the electrical input signals such that a difference in phase responses is substantially constant over frequency in a frequency band audible to a human listener, where the phase shifter unit comprises at least one of an all-pass filter and a delay unit where the phase shifter unit further comprises at least three chains of serially-connected all-pass filters that includes a first chain, a second chain and a third chain, where the first chain is supplied with one of the first and the second additional electrical signals, where the second chain is supplied with one of the two electrical input signals, and where the third chain is supplied with the other one of the two electrical input signals; and where each chain has a certain total filter order such that the total filter orders of the second and the third chains are equal, but smaller than the total filter order of the first chain.

5. The system of claim 4, where the signal processing unit further comprises a summer unit that generates a first additional electrical signal by adding the two electrical input signals.

6. The system of claim 5, where the signal processing unit further comprises a mixer unit that generates a second additional electrical signal.

7. The system of claim 6, where the mixer unit comprises a matrix decoder.

8. The system of claim 4, where the phase shifter unit comprises two delay units, where one of the two delay units is supplied with one of the two electrical input signals, and where the other one of the two delay units is supplied with the other one of the two electrical input signals.

9. The system of claim 4, where the two electrical input signals include a front right signal and a front left signal;

where the two loudspeakers include a front right loudspeaker and a front left loudspeaker; and where the front right signal drives the front right loudspeaker and the front left signal drives the front left loudspeaker.

10. The system of claim 6, further comprising a plurality of additional loudspeakers, and where the mixer unit generates further additional electrical signals to drive the additional loudspeakers.

* * * * *

UNITED STATES PATENT AND TRADEMARK OFFICE

CERTIFICATE OF CORRECTION

PATENT NO. : 8,520,862 B2
APPLICATION NO. : 12/592282
DATED : August 27, 2013
INVENTOR(S) : Leander Scholz It is certified that error appears in the above-identified patent and that said Letters Patent is hereby corrected as shown below:

In the Specification

Column 11
Line 64, please delete "foamed" and insert -- formed --

Signed and Sealed this
Fifteenth Day of October, 2013

Teresa Stanek Rea
*Deputy Director of the United States Patent and Trademark Office*